US007112162B2

(12) United States Patent
Greenland

(10) Patent No.: US 7,112,162 B2
(45) Date of Patent: Sep. 26, 2006

(54) EXERCISE MACHINE

(76) Inventor: Darrell Greenland, 938-4th St., Apt. 109, Santa Monica, CA (US) 90403

( * ) Notice: Subject to any disclaimer, the term of this patent is extended or adjusted under 35 U.S.C. 154(b) by 467 days.

(21) Appl. No.: 10/348,746

(22) Filed: Jan. 21, 2003

(65) Prior Publication Data

US 2003/0134721 A1 Jul. 17, 2003

Related U.S. Application Data

(63) Continuation-in-part of application No. 10/053,325, filed on Jan. 17, 2002, now Pat. No. 6,905,446.

(51) Int. Cl.
*A63B 21/072* (2006.01)
*A63B 21/078* (2006.01)
*A63B 21/08* (2006.01)

(52) U.S. Cl. ..... 482/94; 482/97; 482/104; 482/108

(58) Field of Classification Search ..... 482/92–94, 482/97, 100, 101, 104, 106–108, 133, 134, 482/138, 139
See application file for complete search history.

(56) References Cited

U.S. PATENT DOCUMENTS

| | | | | | |
|---|---|---|---|---|---|
| 4,406,452 | A * | 9/1983 | Lapcevic | 482/97 |
| 4,615,524 | A * | 10/1986 | Sutherland | 482/104 |
| 4,974,835 | A * | 12/1990 | Klink | 482/97 |
| 5,788,614 | A * | 8/1998 | Simonson | 482/97 |
| 5,813,951 | A * | 9/1998 | Einsig | 482/97 |
| 5,836,858 | A * | 11/1998 | Sharff | 482/106 |
| 6,283,898 | B1 * | 9/2001 | Polidi | 482/104 |
| 6,482,135 | B1 * | 11/2002 | Ish et al. | 482/97 |
| 6,592,498 | B1 * | 7/2003 | Trainor | 482/97 |
| 6,905,446 | B1 * | 6/2005 | Greenland | 482/100 |

* cited by examiner

*Primary Examiner*—Gregory L. Huson
*Assistant Examiner*—Victor K. Hwang
(74) *Attorney, Agent, or Firm*—Cislo & Thomas, LLP

(57) ABSTRACT

An exercise machine providing self spotting for free weights while providing full range motion for free weight articulation.

16 Claims, 4 Drawing Sheets

EXERCISE MACHINE

CROSS-REFERENCE TO RELATED APPLICATIONS

This patent application is a continuation-in-part of U.S. patent application Ser. No. 10/053,325 filed Jan. 17, 2002 now U.S. Pat. No. 6,905,446 issued on Jun. 14, 2005, entitled Exercise Device which application is incorporated herein by this reference thereto.

BACKGROUND OF THE INVENTION

1. Field of the Invention

This invention relates to weightlifting machines and devices, more particularly to a self-spotting weightlifting machine where the weightlifter can lift weights until weary and be able to release the weights without dropping them.

2. Description of the Related Art

Weightlifting is well known in the art, and is a recognized Olympic sport. Additionally, weightlifting provides muscular development especially for the upper body and long muscles of the legs. Weightlifting gyms have become very popular places for activity and socializing as physical exercise generally forms a portion of most persons' days.

When lifting weights, much of the muscle development occurs once the muscles have been warmed up, and become weary from the weightlifting activity. This is particularly true for bodybuilders who lift small weights a great number of times in order to achieve better definition of particular muscle groups. Power lifters generally focus upon the amount of weight that they can lift, and also engage in "repetitions" where a weight of a certain amount is lifted a number of times repeatedly.

In most of these activities, barbells or dumbbells are used. Because the weightlifting activity generally brings the weightlifter to the limit of his or her endurance, it is common to have a second person, called a "spotter," to help the person at the end of the repeated lifting cycle where the weightlifter's endurance begins to fail. The spotter is there to help the weightlifter lift the weight back onto a weight stand (that holds the weight) should the weightlifter be unable to return the weight to the stand. This is an important safety function, as the weight could either drop to the floor or the weightlifter, possibly injuring the weightlifter. The possibility of the latter case can arise when the weightlifter is reclined on a bench and lifting a barbell upwardly in a manner that, due to the weightlifter's reclining position, is directly over the weightlifter. When the weightlifter cannot return the weight to the stand, the barbell then descends by gravity onto the weightlifter. This can be particularly difficult if the barbell should engage the weightlifter's throat or windpipe. Generally, the weightlifter in distress would then turn the barbell to allow it to drop to the floor. However, this is a situation to be avoided, as it shows a lack of control and may injure the equipment as well as third persons.

Consequently, it is a shortcoming present in the art as there are a few, if any, exercise machines or exercise devices that allow the weightlifter to operate on his or her own without demanding the attention and time of a spotter.

There have been previous attempts made in the art with respect to self-spotting weightlifting devices.

U.S. Pat. No. 4,973,050 issued to Santoro on Nov. 27, 1990 for a Pulleyless Weightlifting Apparatus is directed to an apparatus for facilitating free weight exercises so as to prevent injury using barbells or dumbbells. The exercise apparatus 10 has a pair of bases 60, 62 supporting posts 34, 37 containing counterweights 72, 75 that are connected to cables 44, 47 that have connectors at the opposite end for connecting a barbell or dumbbells. The posts have a plurality of apertures for receiving stop pins 8 to limit the travel of the counterweights and also receive hooks 5 for supporting the barbell at a selected location. The weightlifting apparatus allows unrestricted movement of the weight bar or dumbbells, but provides safety to the user, but in a manner differing structurally from the present invention.

U.S. Pat. No. 5,407,403 issued to Coleman on Apr. 18, 1995 for a Forcer Repetition Assist Device is directed to a mechanical weightlifting partner that can be pro-programmed for operational parameters to allow predetermined weightlifting performance with the training partner being transparent to the user unless parameters are exceeded and assistance is necessary. The apparatus 1 has a vertical unit 92 that contains a control unit 58 containing a microprocessor-based control unit 58 that controls a motor controller that is coupled to a system containing a motor 56, clutch 52, encoder 35, as well as a roller chain drive with sprockets and a cable system. The apparatus is programmed through a keypad 72 so that with a barbell 2 or dumbbells 6, 12 connected to cable 22, exercises can be performed without the apparatus being involved unless the encoder determines that rates are being exceeded, then clutch is engaged and assistance is provided to the weightlifter.

U.S. Pat. No. 5,788,616 issued to Polidi on Aug. 4, 1998 for a Mechanical Weightlifting Machine is directed to a mechanical weightlifting machine that serves as a human spotter. The mechanical spotter 10 has a support frame 18 with a vertical support structure 25. An articulating mechanism 32 is provided that can selectively be used with dumbbells or a barbell. The articulating unit has a counterweight 44 that can be adjusted to balance out the weight of the machine so no resistance is felt by the user in raising or lowering free weights, if desired. Drive motor 60 and a foot control 58 are provided for weight adjustment. Rods 40 are suspended from the articulating unit with lower ends 42 that can be connected to a dumbbell or barbell. The downward swing of the weights is limited by stops 72 and the support frame includes a pair of weight rests 74. The disclosed structure does not allow for pivotal displacement in the horizontal plane.

U.S. Pat. No. 5,971,897 issued to Olson et al. on Oct. 26, 1999 for a Multi-Purpose, Natural-Motion Exercise Machine is directed to a multipurpose natural motion exercise machine permitting safe free-ranging motion. The machine has handlebars 26 that are supported on a bearing sleeve 20 that rides on horizontal shaft 16. Shaft 16 is coupled to main bearing sleeve 14 that rides on main shaft 12. Vertical bearing sleeve 14 has a weight bar 30 upon which a desired amount of weights are placed. A safety catch 38 is placed on the vertical shaft to limit the downward motion of the handles and a safety catch 36 is installed on the horizontal shaft 16. The user can provide repetitions of weightlifting using natural elliptical motions provided by bearing slides.

U.S. Pat. No. 4,998,723 issued to Santoro on Mar. 12, 1991 for a Cable Suspended Dumbell [sic] and Barbell Weightlifting Apparatus is directed to a cable suspended dumbbell and barbell weightlifting apparatus that provides safety to the user. The exercise apparatus 10 can support dumbbells 54 or a barbell 80 on the end of the two cables 58 that can be adjusted to a pre-selected height by positioning slider assemblies 44, 46 on guide track support members 40 and inserting key stops 32 through holes 60 in the guide track.

It can be seen that the art would be advanced by a self-spotting exercise device that would allow weightlifters to lift weights without risking injury or dropping the weights, as well as requiring the services of a spotter. This would further allow individuals to exercise with weights independently of others, as well as providing a safe means by which to do so.

With respect to dumbbells, self-spotting mechanisms have been fewer and remain to be fully developed. The use of a self-spotting mechanism for a dumbbell allows the weightlifter to engage in vigorous or depleting physical activity while remaining confident that the dumbbells will not fall and possibly damage equipment (including the dumbbell itself) or injure someone. Consequently, the art remains to be developed with respect to self-spotting devices for dumbbells and the like. Development of such self-spotting devices enable weightlifters to better concentrate their exercise on certain muscle groups and/or exercises according to the preference of the weightlifter without being constricted to problems that may arise by using dumbbells in the form of free weights.

SUMMARY OF THE INVENTION

In view of the foregoing disadvantages inherent in the known types of self-spotting devices, particularly for free weights such as dumbbells and barbells, now present in the prior art, the present invention provides a self-spotting mechanism that enable a weightlifter to have free weights spotted mechanically wherein the weightlifter can safely and easily use such free weights while enjoying the benefits of spotting.

The general purpose of the present invention, which will be described subsequently in greater detail, is to provide self spotting for free weights, particularly pairs of dumbbells, such self-spotting devices having many of the advantages of prior self-spotting mechanisms heretofore and many novel features that result in new self-spotting exercise machines which are not anticipated, rendered obvious, suggested, taught, or even implied by any of the prior art self-spotting devices, either alone or in any combination thereof.

The exercise machine set forth herein provides self-spotting means for free weights, particularly dumbbells.

In a first embodiment, an exercise machine has internal skeletal framework upon which the self-spotting system may be adjustably disposed. A counterweight may serve to help the raising and lowering of the adjustable framework. A large crossbeam serves as a rest upon which free weight holders may rest. A pair of rearwardly-extending arms from the main crossbar engage articulating joint members which are then coupled to the free weight holders. The free weight holders then rest upon the main crossbar when not in use or immediately after use with the horizontal stop acting as the self-spotting member. Alternative embodiments of the free weight holder include rigid or telescoping engagement rods which are coupled to the articulating member at the rear of the rearwardly-extending arms that project from the horizontal stop.

In an alternative embodiment, a horizontal stop is still used but a central projecting member has outwardly projecting articulating arms that engage the free weight holders. The free weight holders have hooks near a joint adjacent a dumbbell-engaging portion that hooks upon a framework coupled to the adjustable portion which includes the horizontal stop. The horizontal stop serves as the spotting mechanism upon which a dumbbell holder may rest either prior to or after exercise. The hook mechanisms then provide means by which the dumbbell holders and accompanying dumbbells may be suspended by the framework.

OBJECTS OF THE INVENTION

It is an object of the present invention to provide a self-spotting system for free weights, including dumbbells and barbells.

It is another object of the present invention to provide an adjustable self-spotting system for free weights.

It is yet another object of the present invention to provide a self-spotting system for free weights that is subject to articulation with a significant degree of spatial freedom.

It is yet another object of the present invention to provide a self-spotting system for free weights that enables the free weights to be suspended above a self-spotting mechanism.

It is yet another object of the present invention to provide free weight holders that enable self-spotting mechanisms.

These and other objects and advantages of the present invention will be apparent from a review of the following specification and accompanying drawings.

DESCRIPTION OF THE PREFERRED EMBODIMENT(S)

The detailed description set forth below in connection with the appended drawings (if any) is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
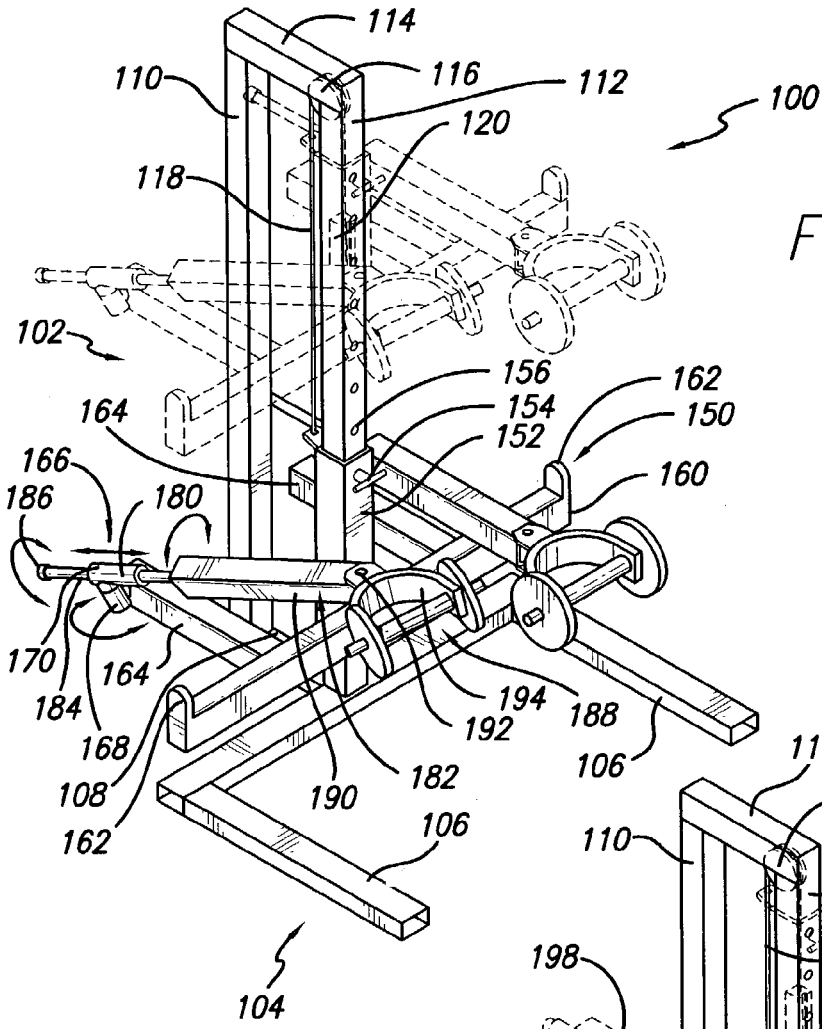
FIG. 1 is a right top perspective view of a first embodiment of the self-spotting free weight exercise machine of the present invention. Shown in phantom is the self-spotting mechanism displaced vertically from the one shown in FIG. 1.

Referring now to FIG. 1, the exercise machine 100 of the present invention has a basic framework 102 that includes a floor-engaging support section 104 with extending legs 106, a rearward floor projection 108, a rear upstanding post 110, a front upstanding post 112, and a top post connection piece 114 which connects the front and rear upstanding posts at the top of each.

Near the top of the front upstanding post 112 is a pulley 116 over which a line 118 runs. The line 118 is connected to a counterweight 120 which serves to balance the self-spotting framework 150.

The self-spotting framework 150 has a central sleeve 152 which slidably engages the front upstanding post 112. As is known in the art, the central sleeve 152 may be temporarily fixed to the front upstanding post 112 by means of a pin 154 passing through a hole in the central sleeve 152 and into the front upstanding post 112 via one in a series of spaced holes 156.

Attached to the central sleeve 152 at a right angle thereto is a horizontal stop in the form of an abutment stop or major crossbar 160 which acts as a horizontal stop, or spotter, to prevent and limit the downward travel of the free weights 188 by engaging the free weight engagers 190. The horizontal stop 160 has upstanding ends 162 at either side thereof. The upstanding ends 162 generally prevent the free weights from falling off the sides of the horizontal stop 160 by impeding the travel of the free weight engagers past the end of the horizontal stop 160.

Approximately equally spaced from the central sleeve 152 and the upstanding ends 162 of the horizontal stop 160 are rearwardly-extending members, or posts, 164. The rearwardly-extending members generally extend rearwardly past the rear upstanding post 110. The length of the rearwardly-extending members 164 is not necessarily of significance as such length does not generally determine the resistance offered by the free weights. At the rear ends of the rearwardly-extending members 164 are articulating members 166, each rearwardly-extending member 164 generally having a single articulating member 166. The articulating members 166 may be disposed on the outside of each rearwardly-extending member 164. However, alternative embodiments and positions may also be advantageously realized.

The articulating members 166 are pivotably coupled to the rearwardly-extending member 164 by a set of two right angled bushings. The lower bushing 168 pivotably connects the articulating member 166 to the rearwardly-extending member 164. The lower bushing 168 articulates in a generally circular manner pivoting upon the side of the rearwardly-extending member 164 as shown in FIG. 1. The upper bushing 170 is pivotably coupled to the lower bushing and pivots circularly upon the top of the lower bushing 168. With the cooperation of the upper and lower bushings 170, 168, the articulating member 166 is able to articulate both parallel to the rearwardly-extending member 164 by means of the lower bushing 168 as well as perpendicularly to the rearwardly-extending member 164 due to the upper bushing.

The upper bushing 170 has a sleeve 180 through which a rod may fit. As shown in FIG. 1, the free weight holder 182 has a rearwardly-extending rod or shaft 184 which travels through the sleeve 180 of the upper bushing 170. The rearwardly-extending rod terminates in a stop 186 which prevents the rod 184 from disengaging the sleeve 180. The front of the rod 184 is connected to the free weight, in this case a dumbbell, 188 by means of a free weight engager 190 which is coupled to the free weight 188 by a joint 192. The joint 192 is coupled to a free weight-engaging portion, or bracket, 194. The joint 192 allows the free weight to articulate laterally with respect to the free weight engager 190. As the rearwardly-extending rod 184 of the free weight holder 182 is able to turn within the sleeve 180, a broad degree of freedom is given to the free weight 188 as it could pivot and articulate as well as travel in a wide variety and large number of angles with respect to the rearwardly-extending member to which it is coupled via the articulating member 166.

As currently-contemplated, the rearwardly-extending rod 184 travels through the sleeve 180 to the extent possible as allowed by the stop 186 (controlling the forward extent of the rod's 184 travel) and by the free weight engager 190 (controlling the rearward extent of the rod's 184 travel).

Figure 2:
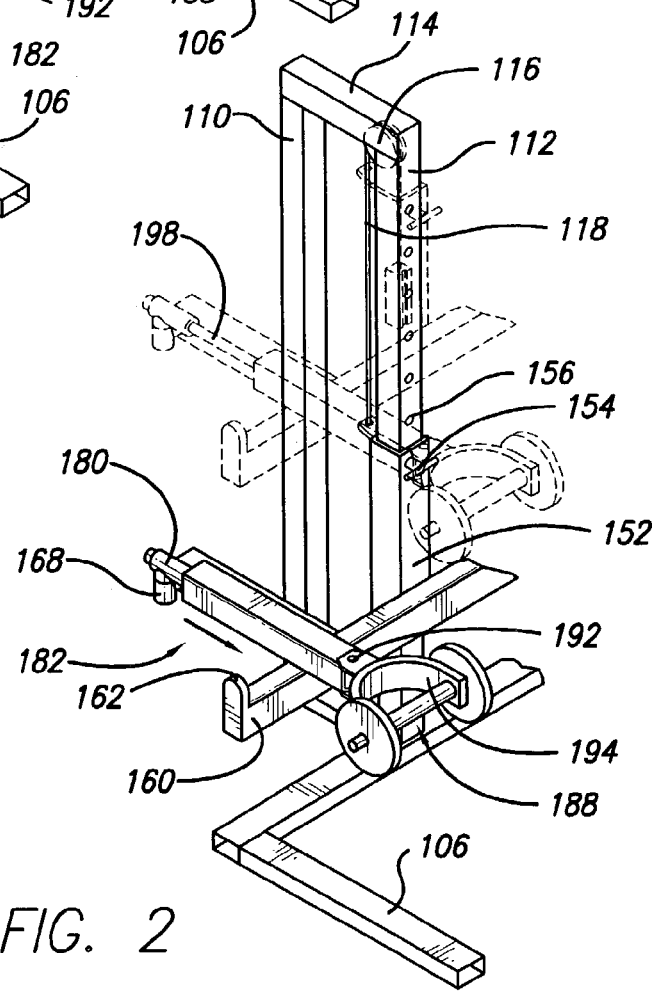
FIG. 2 is a partial sectional view of an alternative embodiment of the self-spotting exercise machine for free weights as shown in FIG. 1 with an alternative free weight holder. Shown in phantom is the pertinent portion of the right free weight holder and the horizontal stop in an elevated position.

As shown in FIG. 1, the left and right free weight holders 182 and articulating members 166 operate in a generally similar manner, the two generally being mirror images of one another. As indicated in FIGS. 1 and 2, the free weights 188 are articulatable in forward, rearward, upward, downward, right, and left directions with respect to the rearwardly extending member 164

As can be seen by visual inspection of FIG. 1, when the free weights 188 are released, they come to rest on the horizontal stop 160 with the free weight engager 190 generally coming into contact with and resting upon the horizontal stop 160. The horizontal stop 160 acts and operates as a lower abutment, rest, or support on which the free weight engager 190 may be supported and its downward travel limited.

As shown in phantom in FIG. 1, the central sleeve 152 may travel vertically along the front upstanding post 112. The counterweight 120 attached to the line or cable 118 is coupled to the central sleeve. The upward travel of the central sleeve 152 causes the descent of the counterweight 120 within the confines of the front upstanding post 112. The line or cable 118 transmits the weight of the counterweight 120 to the central sleeve 152 and the adjoining self-spotting framework 150 and vice versa. If the counterweight 120 is sufficiently heavy, it can counterbalance the entire weight of the self-spotting framework 150 but due to the extensive and large nature of the self-spotting framework 150, generally only part of the weight of the self-spotting framework 150 may be balanced by the counterweight 120.

In use, the weightlifter may manually engage the free weight 188 and use it as he would any other free weight save the fact that he need not drop the free weight to the floor once he/she is through. The operation of the self-spotting framework 150 serves to allow the weightlifter to lay the free weight 188 to rest with the free weight engager 190 engaging the horizontal stop 160.

In FIG. 2, an alternative embodiment of the free weight holder 182 is shown. Instead of the rearwardly-extending rod 184 being rigid in nature and passing through the sleeve 180, the rearwardly-extending rod 198 telescopes into and out of the free weight engager 190. The articulating member 166 operates generally the same save that the end of the rearwardly-extending rod 198 is fixed with respect to the sleeve 180. The free weight 188 is then free to travel to and fro with the rearwardly-extending rod traveling into and out of the free weight engager 190. Generally, in most (if not all) aspects, the operation of the alternative embodiment of the free weight holder as shown in FIG. 2 is the same as that shown in FIG. 1.

Figure 3:
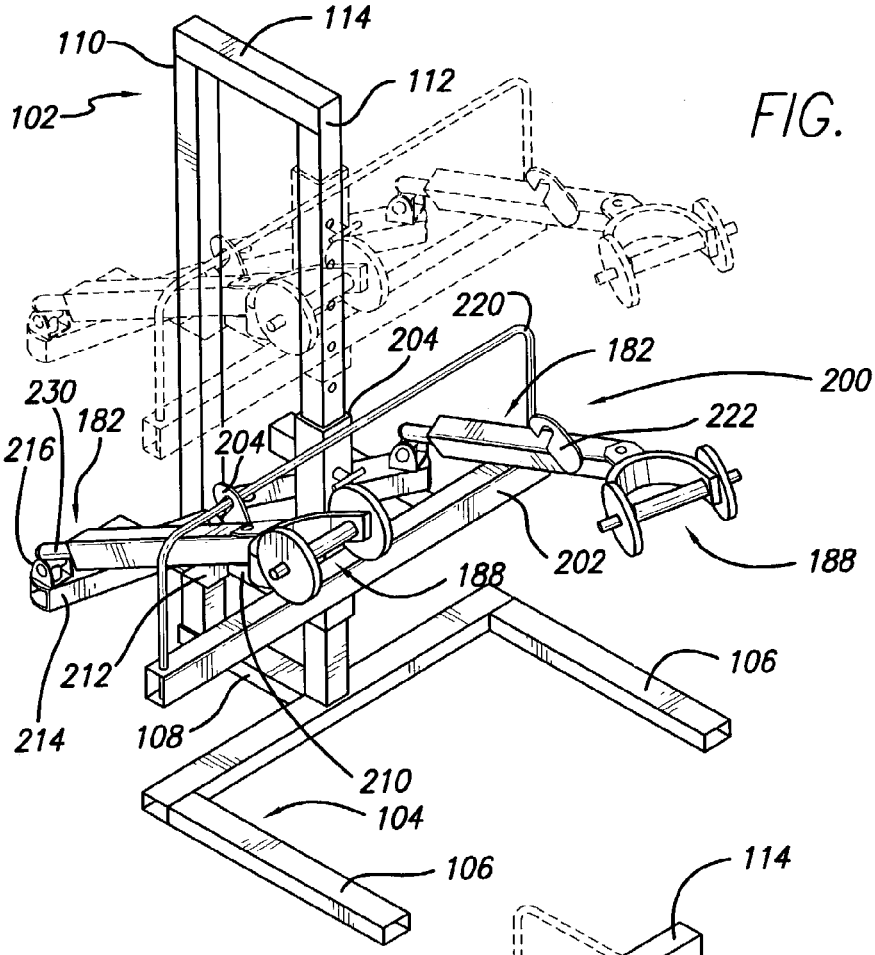
FIG. 3 is a top front right perspective view of an alternative embodiment of the self-spotting exercise machine for free weights. Shown in phantom is the self-spotting mechanism offset upwardly from a lower position.
Figure 4:
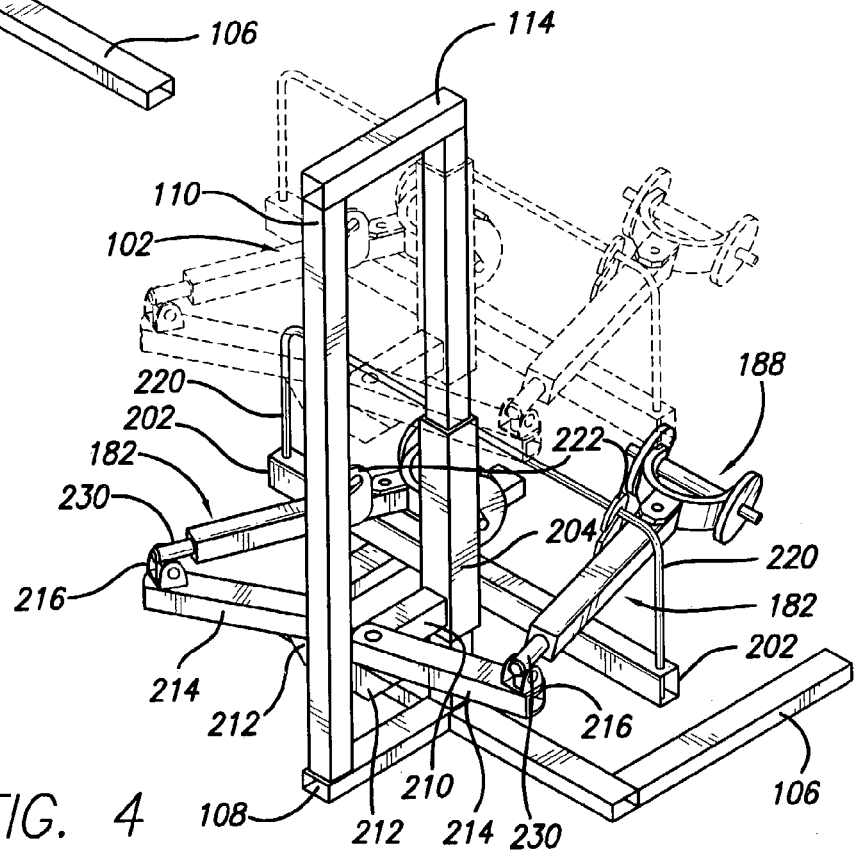
FIG. 4 is a top rear right perspective view of an alternative embodiment of the self-spotting exercise machine for free weights shown in FIG. 3. Shown in phantom is the self-spotting mechanism offset upwardly from a lower position.

In FIGS. 3 and 4, a self-spotting framework 200 is shown as an alternative embodiment of the present invention. The self-spotting framework 200 has a horizontal stop 202 that is attached to a central sleeve 204 which travels on a basic framework 102 similar to that shown in FIG. 1. In FIGS. 3 and 4, the elements of the basic framework 102 similar to those in FIG. 1 are indicated by similar reference numbers. A central sleeve 204 of the self-spotting framework 200 shown in FIGS. 3 and 4 operates the same with respect to the front upstanding post 112 as previously described with respect to the operation of the self-spotting framework 150 in FIG. 1.

A single rearwardly-extending member 210 may travel rearwardly from the central sleeve towards the rear upstanding post 110. The rearwardly-extending member is coupled to a small cross member 212. Opposing arms 214 extend outwardly laterally left and right to engage the free weight holders 182 via an articulating joint 216. The articulating joint may pivot circularly with respect to the associated opposing arm 214 and may allow the attached free weight holder 182 to pivot laterally thereon in manner similar to a lever attached via a pin to a bracket. In this case, the bracket would be pivotably attached to the end of the opposing arm 214 in order to achieve one embodiment of the articulating joint 216.

In one embodiment, the horizontal stop 202 has a U-shaped transverse rail 220 that extends upwardly from the opposite ends of the horizontal stop 202 and travels parallel and coplanar with the horizontal stop 202 such that the free weight holders 182 have a significant amount of room in which to operate and articulate to allow the weightlifter freedom of motion between the transverse rail 220 and the horizontal stop 202. The transverse rail 220 serves as a support on which the free weight holders 182 may be hung via hooks 222. The hooks may be attached at propitious location on the sides or elsewhere on the free weight holders 182 such that the free weight holders may be temporarily attached to the transverse rail 220 via the rail hooks 222. As indicated above, generally in all other aspects, the free weight holders 182 shown in FIGS. 3 and 4 are similar to those shown in FIGS. 1 and 2. One difference in the free weight holders 182 is the fact that the rearwardly-extending rods 184, 198 shown in FIGS. 1 and 2, respectively, may be omitted with just a stub or other small extension 230 coupled to the articulating joint 216. Due to the articulating nature of the opposing arms, the extension previously provided by the rearwardly-extending rods 184, 198 of FIGS. 1 and 2, respectively, are not needed.

The opposing arms 214 are pivotally coupled to the cross member 212 as well as the articulating joint 216. When the free weight 188 is brought forward, the associated opposing arm then pivots with respect to the cross member 212 and the articulating joint 216 to likewise move forward through an angular displacement generally centered on the cross member 212.

Figure 5:
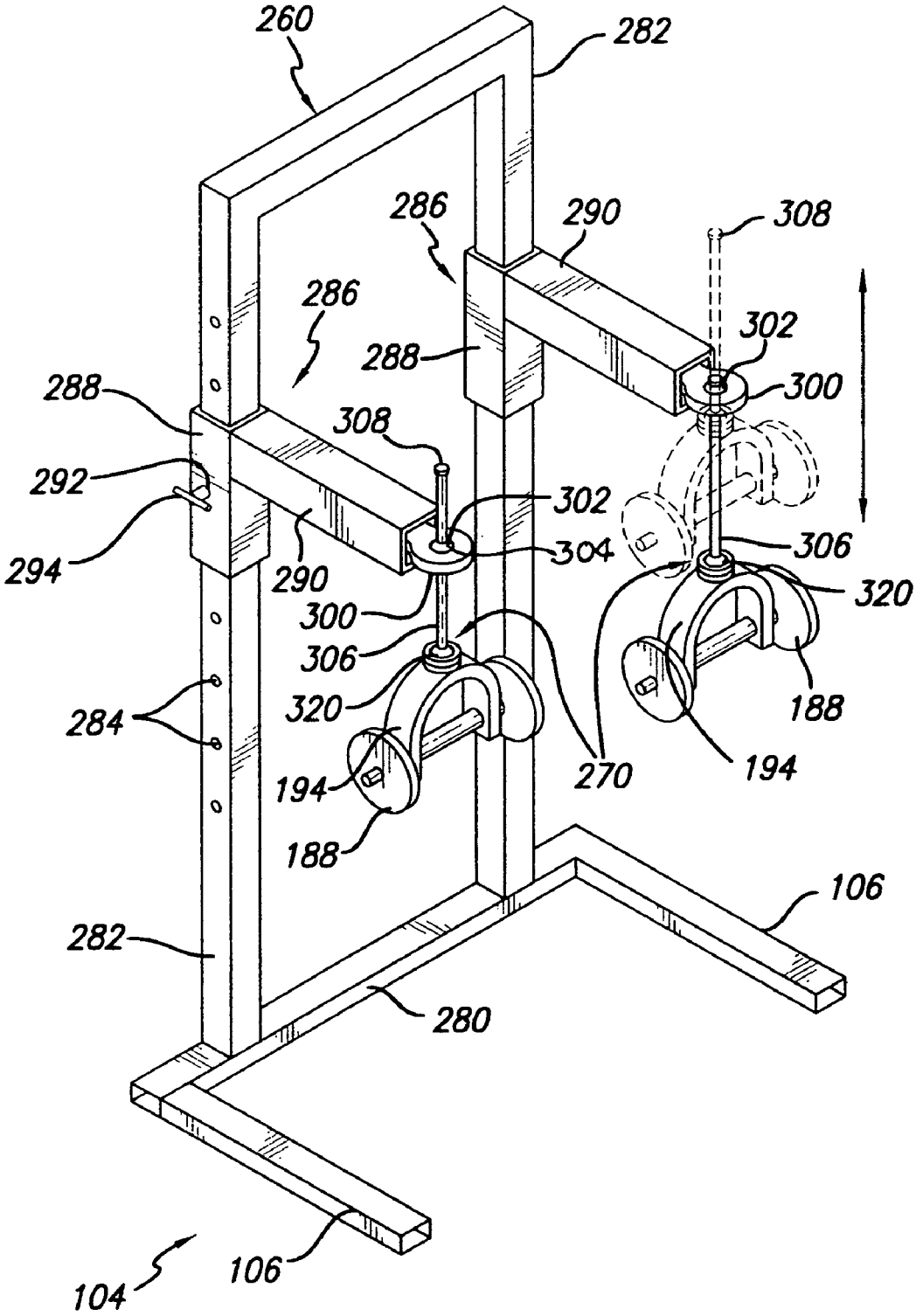
FIG. 5 is a right side perspective view of a self-spotting exercise machine for free weights, showing the use of dumbbells therefor, with the left side being shown offset upwardly in phantom with the right side as shown disposed halfway through the spherical rod end.
Figure 6:
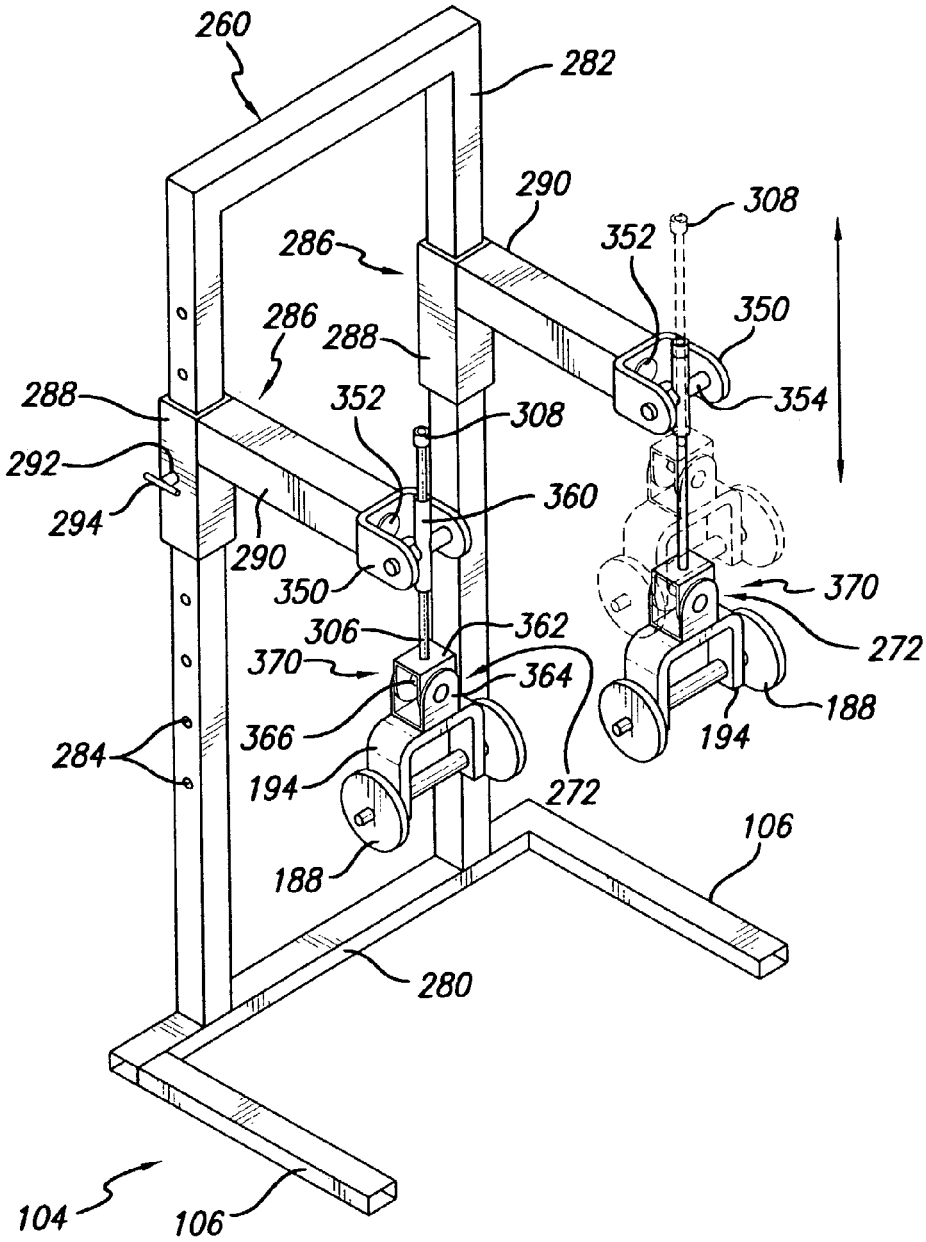
FIG. 6 is a right side perspective view of a self-spotting exercise machine for free weights showing the use of dumbbells therefor, with the left side shown in an upwardly extended position in phantom and the right side shown halfway disposed in the slide joint.

Shown in FIGS. 5 and 6 are alternative embodiments of the present invention for use in conjunction with free weights, including barbells and dumbbells. As shown in FIGS. 5 and 6, dumbbells are used with free weights 188. FIG. 5 uses spherical rod ends or the like 270 to effect articulation while in FIG. 6, slide joints 272 are used.

Spherical rod ends, or heim joints, are well known in the art and are generally those having a ball through which a shaft may be passed or connected, the ball held in a housing or casing that allows the free rotation of the ball. Slide joints are known in the art and may be such as those known as recirculating ball linear bearings in order to provide lower friction and better operation for the slide joints.

As shown in FIG. 5, a floor-engaging support section 104 similar to that shown in FIGS. 1–3 has projecting legs 106 connected at the rear thereof of rear crossing support 280. Upstanding members 282 are disposed on either side of the center of the rear crossing support 280. The upstanding members 282 generally have attachment holes 284 regularly spaced along the exterior sides of the upstanding members 282. A weight supporting member 286 has a sliding sleeve 288 and a forwardly-extending member 290. Each of the upstanding members 282 has a weight supporting member 286 by which the free weights 188 may be supported.

The sliding sleeve 288 has a hole 292 through which a pin 294 may pass into the holes 284 of the upstanding member 282 when the two holes 292, 284 are aligned. The pin 294 then supports the weight supporting member 286 and any free weight 188 that may be upon it in the selected position. In this way, the height of the free weights 188 may be adjusted for lifting by a weightlifter.

As shown in FIG. 5, the forwardly-extending members 290 are attached at an upper portion of the sliding sleeve 288. This configuration is optional and other positionings of the forwardly-extending 290 with respect to the sliding sleeve may be achieved to good effect. The forwardly-extending members 290 extend in a direction generally parallel to legs 106 on the order of a foot or two. Generally, the distance before the extending members 290 distance the free weights 188 from the basic framework 260 so that a weightlifter has adequate room in order to use the free weights 188.

Forwardly-extending members 290 terminate in post extensions 300 that serve as one-half of the upper spherical rod end 302 by providing a housing for the articulating ball 304 of the upper spherical rod end 302. The articulating ball 304 has a central cylindrical hole passing therethrough. A rod 306 passes through the spherical rod end 302 via the hole and is prevented from falling therethrough by rod end 308 that is of greater diameter than the spherical rod end hole. The free weight 188 attached to the rod 306 pulls the rod downwardly. The rod 306 terminates in a second spherical rod end 320 which attaches to the bracket 194. The bracket 194 holds the free weight 188. The lower spherical rod end 320 may serve as the free weight engager, corresponding to the same or similar structure in the other embodiments of the present invention. The lower spherical rod end 320 couples the free weight 188 with the rod 306.

By effecting the construction set forth above and as indicated by FIG. 5, a weightlifter may position a weight bench below the suspended free weights 188. The sliding sleeve 288 may be adjusted in order to bring the free weights 188 to hand or shoulder level. In a reclining or other position, the weightlifter may then engage the free weights 188 manually and lift them upwardly in order to engage in weightlifting activity. The operation and articulation of spherical rod ends is well known and serves to provide significant freedom of motion with respect to the free weights 188 as they may pivot and articulate with respect to the upper and lower spherical rod ends 302, 320. When the free weights are pressed upward, the rod 306 travels through the upper spherical rod end 302 in order to effect vertical displacement of the free weight 188. In this way, the weightlifter may engage in weightlifting activity, generally for the arms, and while reclining on a weight bench (not shown) or otherwise.

The same operation is similarly true for the embodiment shown in FIG. 6. While the basic framework 260 remains generally the same, and like reference numbers are used to indicate like elements in FIGS. 5 and 6, the articulating structure enabling the free weights 188 to enjoy the self-spotting nature, it departs from the spherical rod end configuration shown in FIG. 5, but instead uses slide joints in conjunction with pivotable U-brackets in order to effect the same end.

In FIG. 6, an upper U-bracket 350 is attached to the forwardly-extending member 290. A bolt head or similar construct 352 serves to keep the upper U-bracket in place. It allows it to rotate about the bolt head 352 to provide a circular or radial degree of freedom for the accompanying free weight 188. The upper U-bracket 350 has a pin 354 passing generally symmetrically through each of the two arms of the upper U-bracket 350. The pin 354 may be stationary or rotate with respect to the upper U-bracket. The pin 354 may generally be two oppositely-opposed arms extending outwardly in linear fashion from the slide joint 360. The slide joint encircles the rod 306 which end 308 thereof has a wider diameter than that provided by the slide joint 360. The wider rod end 308 prevents the downward travel of the rod 306 through the slide joint 360 and prevents downward travel of the free weight 188 past the point where the rod end 308 engages the slide joint 360.

The end of the rod 306 opposite that of the upper rod end 308 terminates in a U-bracket 362. As shown in FIG. 6, the rod U-bracket 362 may be of a narrower dimension than a weight U-bracket 364 which engages the rod U-bracket 362 via a pin 366 about which both the rod U-bracket 362 and the weight U-bracket 364 may pivot/articulate. The weight U-bracket 364 is connected to the weight bracket 194 which selectively holds and engages the free weight 188. The operation of the U-bracket system shown in FIG. 6 is similar to that of the spherical rod end system shown in FIG. 5. A weightlifter generally positions a weight bench beneath the free weights 188 and positions the sliding sleeves 288 such that the free weights 188 are approximately shoulder level. The weightlifter can then manually engage the free weights 188 and lift them vertically in order to engage in weight-lifting activity. The lower U-bracket system 370 (comprising the rod U-bracket 362 and weight U-bracket 364) allows the free weight 188 to pivot with respect to the rod 366. The rod may pivot or rotate within the slide joint 360 in order to dispose the free weight 188 in a wide variety of angular positions. The upper U-bracket pin 354 allows the slide joint 360 to pivot within the upper U-bracket 350. In culmination, the lower U-bracket 370, slide joint 360 and upper U-bracket 350 provide a significant degree of articulatible freedom for the associated free weight 188.

A variety of materials may be used to construct the exercise machine of the present invention, however steel or iron is currently believed to be the best and most convenient material by which the appropriate individual elements of the present device may be constructed.

While the present invention has been described with regards to particular embodiments, it is recognized that additional variations of the present invention may be devised without departing from the inventive concept.

What is claimed is:

1. A self-spotting mechanism for free weights in conjunction with a weightlifting machine, comprising:

a free weight engager for engaging a free weight, said free weight engager including a bracket, said bracket capable of engaging a handle of a free weight;

a joint coupling said free weight engager, said joint allowing said free weight engager to pivot;

a rod coupled to said free weight engager;

an articulating member coupled to said rod, said articulating member enabling said rod to articulate with respect to said articulating member;

said free weight engager articulatable with respect to said articulating member in forward, rearward, upward, downward, right, and left directions to provide a free range of motion;

an abutment stop, said abutment stop engaging said free weight engager to prevent downward travel of said free weight engager;

a rearwardly-extending member coupled at one end to said articulating member and at another end to said horizontal stop, said rearwardly-extending member coupling said articulating member to said horizontal stop;

an upstanding post; and a sleeve slidably engaging and selectably coupleable to the upstanding member, said sleeve coupled to said horizontal stop so that a height of said horizontal stop may be adjusted by adjustment of said sleeve with respect to said upstanding member.

2. A self-spotting mechanism for free weights in conjunction with a weightlifting machine as set forth in claim 1, further comprising:

said rod rigidly attached to said free weight engager and slidably attached to said articulating member so that said rod is able to reciprocate through said articulating member.

3. A self-spotting mechanism for free weights in conjunction with a weightlifting machine as set forth in claim 1, further comprising:

said rod telescopically coupled to said free weight engager and rigidly attached to said articulating member so that said rod may reciprocate into and out of said free weight engager.

4. A self-spotting mechanism for free weights in conjunction with a weightlifting machine as set forth in claim 1, further comprising:

a transverse rail coupled to said abutment stop at opposite ends thereof, said transverse rail extending upwardly away from said abutment stop to provide an opening within which said free weight engager may travel; and a rail hook coupled to said free weight engager, said rail hook selectably engaging said transverse rail to selectably attach said free weight engager to said transverse rail.

5. A self-spotting mechanism for free weights in conjunction with a weightlifting machine as set forth in claim 4, further comprising:

said rearwardly-extending member coupled to said horizontal stop via said sleeve; and an articulating arm pivotably coupled to said rearwardly-extending member, said articulating member articulably coupled to said articulating arm.

6. A self-spotting mechanism for free weights in conjunction with a weightlifting machine, comprising:

a free weight engager for engaging a free weight;

a joint coupled to a free weight engager allowing said free weight engager to pivot;

a rod coupled to said free weight engager; and an articulating member coupled to said rod, said articulating member enabling said rod to articulate with respect to said articulating member; and said free weight engager articulatable with respect to said articulating member in forward, rearward, upward, downward, right, and left directions, further comprising a horizontal stop, said horizontal stop engaging said free weight engager to prevent downward travel of said free weight engager; and a rearwardly-extending member coupled at one end to said articulating member and at another end to said horizontal stop, said rearwardly-extending member coupling said articulating member to said horizontal stop.

7. A self-spotting mechanism for free weights in conjunction with a weightlifting machine as set forth in claim 6, further comprising:

an upstanding member post; and a sleeve slidably engaging and selectably coupleable to the upstanding post, said sleeve coupled to said horizontal stop so that a height of said horizontal stop may be adjusted by adjustment of said sleeve with respect to said upstanding post.

8. A self-spotting mechanism for free weights in conjunction with a weightlifting machine as set forth in claim 7, wherein said horizontal stop further comprises:

an abutment stop.

9. A self-spotting mechanism for free weights in conjunction with a weightlifting machine as set forth in claim 7, further comprising:

a transverse rail coupled to said horizontal stop at opposite ends thereof, said transverse rail extending upwardly away from said horizontal stop to provide an opening within which said free weight engager may travel; and a rail hook coupled to said free weight engager, said rail hook selectably engaging said transverse rail to selectably attach said free weight engager to said transverse rail.

10. A self-spotting mechanism for free weights in conjunction with a weightlifting machine as set forth in claim 9, further comprising:

said rearwardly-extending member coupled to said horizontal stop via said sleeve; and an articulating arm pivotably coupled to said rearwardly-extending member, said articulating member articulably coupled to said articulating arm.

11. A self-spotting mechanism for free weights in conjunction with a weightlifting machine comprising:

a pair of free weight engagers for engaging a free weight;

a joint coupled to each of said weight engagers allowing said free weight engagers to pivot;

a rod coupled to each of said free weight engagers;

an articulating member coupled to each of said rods, said articulating member enabling each of said rods to articulate with respect to said articulating member;

said rod rigidly attached to said free weight engager and slidably attached to said articulating member so that said rod is able to reciprocate through said articulating member; and said free weight engagers articulatable with respect to said articulating member in forward, rearward, upward, downward, right, and left directions, each of said free weight engagers being independently movable with respect to each other.

12. A self-spotting mechanism for free weights in conjunction with a weightlifting machine as set forth in claim 11, further comprising:

a horizontal stop, said horizontal stop engaging said free weight engagers to prevent downward travel of said free weight engagers; and a rearwardly-extending member coupled at one end to said articulating member and at another end to said horizontal stop, said rearwardly-extending member coupling said articulating member to said horizontal stop.

13. A self-spotting mechanism for free weights in conjunction with a weightlifting machine as set forth in claim 12, further comprising:

an upstanding member post; and a sleeve slidably engaging and selectably coupleable to the upstanding post, said sleeve coupled to said horizontal stop so that a height of said horizontal stop may be adjusted by adjustment of said sleeve with respect to said upstanding post.

14. A self-spotting mechanism for free weights in conjunction with a weightlifting machine as set forth in claim 13, wherein said horizontal stop further comprises:

an abutment stop.

15. A self-spotting mechanism for free weights in conjunction with a weightlifting machine as set forth in claim 13, further comprising:

a transverse rail coupled to said horizontal stop at opposite ends thereof, said transverse rail extending upwardly away from said horizontal stop to provide an opening within which said free weight engagers may travel; and a rail hook coupled to said free weight engagers, said rail hook selectably engaging said transverse rail to selectably attach said free weight engagers to said transverse rail.

16. A self-spotting mechanism for free weights in conjunction with a weightlifting machine as set forth in claim 15, further comprising:

said rearwardly-extending member coupled to said horizontal stop via said sleeve; and an articulating arm pivotably coupled to said rearwardly-extending member, said articulating member articulably coupled to said articulating arm.

* * * * *